US011530554B2

(12) United States Patent
Tubby et al.

(10) Patent No.: US 11,530,554 B2
(45) Date of Patent: Dec. 20, 2022

(54) CABINET SECURITY SYSTEM

(71) Applicant: Dorel Juvenile Group, Inc., Foxboro, MA (US)

(72) Inventors: Lukas Tubby, Manfiled, MA (US); Jimm Hewitt, Norfolk, MA (US); Laura Kay Raffi, Holliston, MA (US); David Sousa, Tiverton, RI (US); Bruce Li, Shenzhen (CN)

(73) Assignee: Dorel Juvenile Group, Inc., Foxboro, MA (US)

( * ) Notice: Subject to any disclaimer, the term of this patent is extended or adjusted under 35 U.S.C. 154(b) by 721 days.

(21) Appl. No.: 16/273,431

(22) Filed: Feb. 12, 2019

(65) Prior Publication Data

US 2019/0257121 A1 Aug. 22, 2019

Related U.S. Application Data

(60) Provisional application No. 62/632,003, filed on Feb. 19, 2018.

(51) Int. Cl.
*E05B 65/44* (2006.01)
*E05B 47/00* (2006.01)
(Continued)

(52) U.S. Cl.
CPC ..... *E05B 65/44* (2013.01); *E05B 47/004* (2013.01); *E05B 65/5223* (2013.01); *E05B 15/0006* (2013.01); *E05B 17/06* (2013.01); *E05B 47/0045* (2013.01); *E05B 57/00* (2013.01); *E05B 65/0014* (2013.01); *E05B 65/46* (2013.01); *E05B 77/26* (2013.01);
(Continued)

(58) Field of Classification Search
CPC .. E05B 47/0045; E05B 57/00; E05B 65/0014; E05B 65/46; E05B 65/44; E05B 47/004; E05B 65/5223; E05B 15/0006; E05B 77/26; E05B 47/0038; E05C 3/006; E05C 3/00; E05C 3/06; Y10T 292/0911; Y10T 292/0945; Y10T 292/0948; Y10T 292/1043; Y10T 292/1075; Y10T 292/1078; Y10T 292/68; Y10T 292/11; Y10T 292/53; Y10T 292/54; Y10S 292/53; Y10S 292/54
USPC ..... 70/276, 78
See application file for complete search history.

(56) References Cited

U.S. PATENT DOCUMENTS 2,970,857 A * 2/1961 Squire ..... E05C 19/16 292/251.5
3,003,802 A 10/1961 Wilson
(Continued)

OTHER PUBLICATIONS

Dreambaby.com "Adhesive Mag Lock" Aug. 30, 2014 https://www.dream-baby.com/adhesive-mag-lockr-4-locks.html (Year: 2014).*
(Continued)

*Primary Examiner* — Christine M Mills
*Assistant Examiner* — Faria F Ahmad
(74) *Attorney, Agent, or Firm* — Barnes & Thornburg LLP

(57) ABSTRACT

A process and apparatus for providing a cabinet security system is disclosed. The system includes a magnetic lock to be mounted on a movable cabinet panel and a catch that is mounted on a cabinet frame and configured to engage the magnetic lock to hold the cabinet panel in a closed position relative to the cabinet frame.

20 Claims, 9 Drawing Sheets

(51) Int. Cl.

| | |
|---|---|
| ***E05C 3/00*** | (2006.01) |
| ***E05B 77/26*** | (2014.01) |
| ***E05B 65/46*** | (2017.01) |
| ***E05B 17/06*** | (2006.01) |
| ***E05B 65/52*** | (2006.01) |
| *E05B 15/00* | (2006.01) |
| *E05B 57/00* | (2006.01) |
| *E05B 65/00* | (2006.01) |

(52) U.S. Cl.
CPC ..... *E05C 3/006* (2013.01); *Y10S 292/53* (2013.01); *Y10S 292/54* (2013.01); *Y10T 292/1078* (2015.04); *Y10T 292/11* (2015.04); *Y10T 292/68* (2015.04)

(56) References Cited

U.S. PATENT DOCUMENTS 3,388,938 A * 6/1968 Peterson ..... E05C 7/04 292/177
3,563,587 A * 2/1971 Hughes ..... E05C 3/00 292/194
3,782,147 A * 1/1974 Hallmann ..... E05B 47/0042 70/276
3,785,188 A * 1/1974 Drathschmidt ..... E05B 17/142 70/276
3,831,986 A * 8/1974 Kobayashi ..... E05B 47/0038 292/201
4,340,100 A 7/1982 Anderson, II
4,593,946 A 6/1986 Rich
4,919,464 A * 4/1990 Richards ..... E05B 47/0038 292/201
5,076,623 A * 12/1991 Richards ..... E05B 47/0038 292/251.5
5,188,405 A * 2/1993 Maccaferri ..... E05B 47/004 292/204
5,485,733 A 1/1996 Hoffman
5,647,618 A 7/1997 Lamberth
5,653,134 A * 8/1997 Lee ..... E05B 13/005 292/169.18
5,671,538 A 9/1997 Lautenschlaeger
5,941,106 A 8/1999 Williamson, Jr. et al.
6,000,735 A 12/1999 Jourdenais
6,006,635 A 12/1999 Stojkovic et al.
6,029,335 A * 2/2000 Hui ..... B25B 27/0035 29/271
6,224,118 B1 * 5/2001 Ashford ..... E05B 17/208 292/202
6,324,948 B1 12/2001 Kavc et al.
6,374,505 B2 4/2002 Myers et al.
6,694,568 B2 2/2004 Baer
7,246,449 B2 7/2007 Pierson et al.
7,350,838 B2 4/2008 Schlattl et al.
8,336,932 B2 12/2012 Roussel et al.
8,397,546 B2 * 3/2013 Varney ..... E05C 3/124 70/276
8,602,465 B2 12/2013 Holmgren
8,813,601 B2 8/2014 Hind et al.
8,894,110 B2 11/2014 Taylor et al.
8,899,636 B2 * 12/2014 Fitzgerald ..... E05B 15/0053 292/251.5
8,938,998 B2 * 1/2015 Haber ..... E05B 47/0038 70/95
9,617,762 B2 4/2017 Fannon et al.
10,174,518 B2 * 1/2019 Andersen ..... E05B 17/06
10,798,830 B2 * 10/2020 Hwang ..... E05C 3/04
D907,454 S * 1/2021 Marsden ..... D8/31
D907,460 S * 1/2021 Marsden ..... D8/343
2007/0113605 A1 * 5/2007 Lopez ..... E05B 47/0044 70/276
2008/0092605 A1 * 4/2008 Johnson ..... E05B 17/2019 70/78
2012/0067090 A1 3/2012 Varney et al.
2014/0189996 A1 7/2014 Wilkens et al.
2015/0059155 A1 3/2015 Duong et al.
2015/0151354 A1 6/2015 Weyland
2016/0002956 A1 1/2016 Trinh et al.
2016/0237725 A1 8/2016 Raffi et al.
2016/0305159 A1 10/2016 Andersen
2019/0032372 A1 * 1/2019 Andersen ..... E05B 65/0014
2019/0257121 A1 * 8/2019 Tubby ..... E05B 47/0045
2021/0079689 A1 * 3/2021 Marsden ..... E05B 65/0014
2021/0189763 A1 * 6/2021 Jean ..... E05B 55/00

OTHER PUBLICATIONS

Dreambabytv "Mag Lock (R) Adhesive Installation [855]" Oct. 15, 2015 https://www.youtube.com/watch?v=LVCjyd5ld1Q—screenshots are included as annotated figures in the Office Action. (Year: 2015).*
Pricepulse.app "Magnetic Cabinet Locks CHild Safety 4 Locks & A Key 3M Adhesive No Drill Hidden Baby Safety Locks for Baby Proofing Cabients Childpreoofing Drawer . . . ." https://www.pricepulse.app/magnetic-cabinet-locks-child-safety-4-locks-a-key_us_15184952.*
Safety 1st, "Adhesive Magnetic Lock System Installation Guide | Safety 1st," Jan. 30, 2018, Youtube.com https://www.youtube.com/watch?v=yEfDK6xAGBU (Year: 2018).*

* cited by examiner

CABINET SECURITY SYSTEM

PRIORITY CLAIM

This application claims priority under 35 U.S.C. § 119(e) to U.S. Provisional Application No. 62/632,003, filed Feb. 19, 2018, which is expressly incorporated by reference herein.

BACKGROUND

The present disclosure relates to cabinet security systems, and particularly to magnetic cabinet locks. More particularly, the present disclosure relates to alignment tools to guide installation of a magnetic cabinet lock in a cabinet.

SUMMARY

A cabinet security system in accordance with the present disclosure comprises several components including a magnetic lock, a catch for the magnetic lock, and a magnetic external key. In illustrative embodiments, the cabinet security system further includes a discardable dual-component installation-alignment module that is used by a lock-installation person in a home or office during a catch-and-magnetic-lock installation activity for a cabinet in a process in accordance with the present disclosure (1) to transport the catch component to a cabinet to be secured so the catch component can be mounted on a cabinet frame and (2) later to position the magnetic lock component on an opened cabinet door or drawer in a proper mounting position so that the magnetic lock component will be aligned with the mounted catch component when the cabinet door or drawer is later closed.

In illustrative embodiments, the discardable dual-component installation-alignment module is engaged at different times to the catch component and to the magnetic lock component to allow a lock installer to align each of those components properly during manual installation of the catch and the magnetic lock in the cabinet by that lock installer. The discardable dual-component installation-alignment module is used by the lock installer first to hold and position the catch component in a proper position on a cabinet frame and then used by the lock installer to position the magnetic lock component in a suitable position on a cabinet panel of a companion cabinet door or drawer to align the magnetic lock component properly with the catch component so that the magnetic lock component engages the catch component when the cabinet door or drawer is later moved relative to the cabinet frame to a closed position. Once the magnetic lock component is positioned properly using the discardable dual-component installation-alignment module, the lock installer holding the magnetic lock component can mount the magnetic lock component on that cabinet panel so that the magnetic lock component remains in a stationary mounted position that will align properly with the catch component when the cabinet door or drawer is later closed. Once the magnetic lock component is mounted on the cabinet panel, the dual-component installation-alignment module is separated from the mounted magnetic lock component by the lock installer handling the installation activity and then may be discarded.

In illustrative embodiments, the dual-component installation-alignment module includes an alignment template made of a plastics material. The module also includes a catch support for temporarily holding the catch component on the alignment template during initial installation of the catch component on the cabinet frame. The module also includes an adhesive template fastener for coupling the alignment template to the cabinet panel during later installation of the magnetic lock component on the cabinet panel. The alignment template of the discardable dual-component installation-alignment module also includes a lock-guide tongue for guiding placement of the magnetic lock component held by the lock installer on an inner surface of a cabinet panel of the cabinet door or drawer during subsequent installation of the magnetic lock component on the cabinet panel of the cabinet door or drawer.

In illustrative embodiments, the alignment template of the discardable dual-component installation-alignment module is generally L-shaped and includes a vertical component-alignment plate that has an inner surface that is sized and shaped to mate with the cabinet frame to align the catch component in a proper position on the cabinet frame during initial installation of the catch component on the cabinet frame. The vertical component-alignment plate has an oppositely facing outer surface that is sized and shaped later to mate with the panel of the cabinet door or drawer during subsequent installation of the magnetic lock component on the cabinet door or drawer. The lock-guide tongue is cantilevered to a lower portion of the vertical component-alignment plate and is relatively longer than the vertical component-alignment plate to establish the L-shape of the alignment template. The catch support is cantilevered to a middle portion of the vertical component-alignment plate and arranged to lie above and in spaced-apart relation to the lock-guide tongue.

In an illustrative process in accordance with the present disclosure, the discardable dual-component installation-alignment module is used by a lock installer to mount a catch component on a cabinet frame. Then the lock installer uses the discardable dual-compartment installation-alignment module to mount a magnetic lock on an inner surface of a panel of a cabinet door on drawer associated with the cabinet frame.

In a first stage of an illustrative process, the lock installer mounts the catch component on the catch support of the discardable dual-component installation-alignment module. Then the lock installer uses the installation-alignment module to position the catch component properly on the cabinet frame so that the catch component can be coupled adhesively to a top strip of the cabinet frame.

In a second stage of an illustrative process, the installation-alignment module then is coupled temporarily and adhesively to an interior surface of a panel included in the cabinet door or drawer while the module is still engaged with the catch component on the cabinet frame and the cabinet door or drawer is in a closed position abutting the cabinet frame. Next, the panel of the cabinet door or drawer is moved away from the cabinet frame by the lock installer to separate the catch support of the discardable dual-component installation-alignment module from the catch component that has been mounted on the cabinet frame. Then, the lock installer manually holds the magnetic lock component in alignment and engagement with a lock-guide tongue of the alignment template included in the discardable dual-component installation-alignment module and uses the module to position the held magnetic lock component properly on the interior surface of the panel of the cabinet door or drawer so as to align with and engage the catch component that is mounted on the cabinet frame when the cabinet door or drawer is later moved to the closed position. Once positioned properly to align with the mounted catch component, the magnetic lock component is coupled adhesively to the interior surface of the panel of the cabinet door or drawer so that it no longer needs to be held in place by the lock installer. Finally, the alignment template of the discardable dual-component installation-alignment module is separated by the lock installer from both of the panel and the magnetic lock component and then discarded by the lock installer.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which:

FIG. 7 shows pre-assembly of the catch component and the catch support of the discardable dual-component installation-alignment module;

FIG. 8 shows removal of an adhesive backing included in a catch-fastener unit that is coupled to the catch while the catch is held on a two-prong catch support that is coupled to the L-shaped alignment template;

FIG. 9 is a perspective view showing an assembly comprising the discardable dual-component installation alignment module and the catch component before the catch component is mounted on the cabinet frame in a manner suggested in FIG. 10;

FIG. 10 is an enlarged view of the catch component after it has been mounted on a top strip of the cabinet frame and before separation of the dual-component installation-alignment module from the mounted catch;

FIG. 11 is a view similar to FIG. 10 showing partial removal of an adhesive backing to expose an adhesive material that is coupled to an outer surface of the short vertical compound-alignment plate included in the L-shaped alignment template;

FIG. 12 is a perspective view showing closure of the cabinet door to cause an interior wall of the panel of the cabinet door to contact the outwardly presented adhesive material of the lock-unit fastener carried on the outer surface of the vertical component-alignment plate of the L-shaped alignment template while the catch support that is attached to the L-shaped alignment template is still coupled temporarily to the latch lip of the catch that is mounted on the top strip of the cabinet frame; and FIG. 13 is a view showing that the vertical component-alignment plate of the L-shaped alignment template is adhered temporarily to the interior wall of the cabinet panel and suggesting diagrammatically that the magnetic lock component is held manually by the hand of a lock installer and positioned on that interior wall using the cantilevered lock-guide tongue included in the L-shaped template of the discardable dual-component installation-alignment module to locate the magnetic lock component on the cabinet panel in alignment with the catch component mounted on the cabinet frame so that once the magnetic lock is released by the lock installer and adhered to the panel, the L-shaped alignment template will be decoupled from the cabinet door panel and the magnetic lock by the lock installer and the entire dual-component installation alignment module will be discarded by the lock installer.

DETAILED DESCRIPTION

Figure 1:
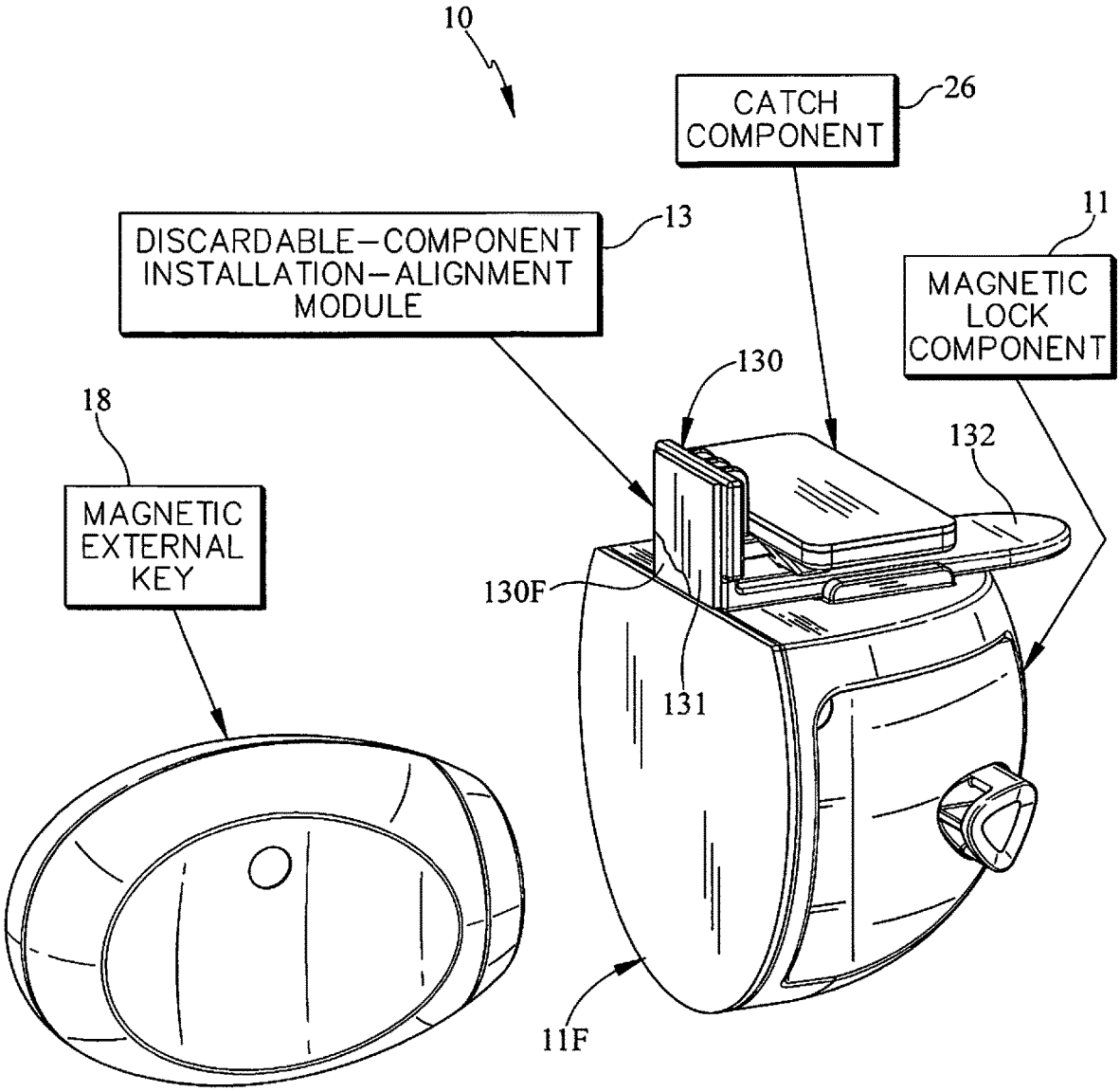
FIG. 1 is a perspective view of a cabinet security system for use in blocking movement of a panel of a cabinet door (or drawer) relative to a cabinet frame as suggested in FIG. 3 and showing that the cabinet security system comprises several components including a magnetic lock, a catch, a magnetic external key, and a discardable dual-component installation-alignment module that can be used by a system installer first to align and mount the catch component on the cabinet frame and then to align and mount position the magnetic lock component on the cabinet panel as suggested diagrammatically in FIG. 6 and illustratively in FIGS. 7-13.

A cabinet security system 10 in accordance with the present disclosure comprises several components including a magnetic lock 11, a catch 26, and a magnetic external key 18 as shown in FIG. 1. A process is disclosed for using a dual-component installation-alignment module 13 also included in cabinet security system 10 in accordance with the present disclosure first to install the catch component 26 and then the magnetic lock component in a cabinet 34 so that the magnetic lock 11 is aligned properly with the catch 26 as shown diagrammatically in FIG. 6 and illustratively in FIGS. 7-13.

Figure 3:
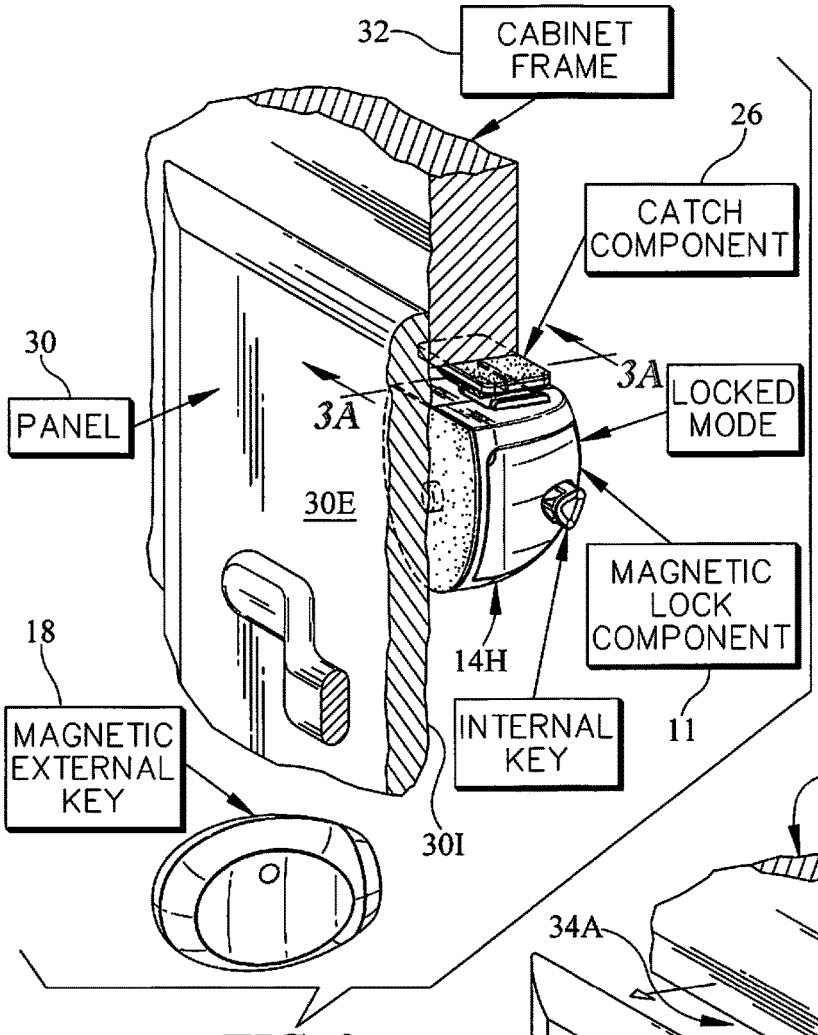
FIG. 3 is a perspective view showing the cabinet security system of FIGS. 1 and 2 after the catch and magnetic lock components have been have been installed by a lock installer on a cabinet using the dual-component installation-alignment module as suggested in FIGS. 7-13 and showing the magnetic lock in a LOCKED mode while the magnetic external key is separated from the cabinet and suggesting that the magnetic lock also includes a mechanical internal key that can be used to unlock the magnetic lock without use of the magnetic external key.
Figure 4:
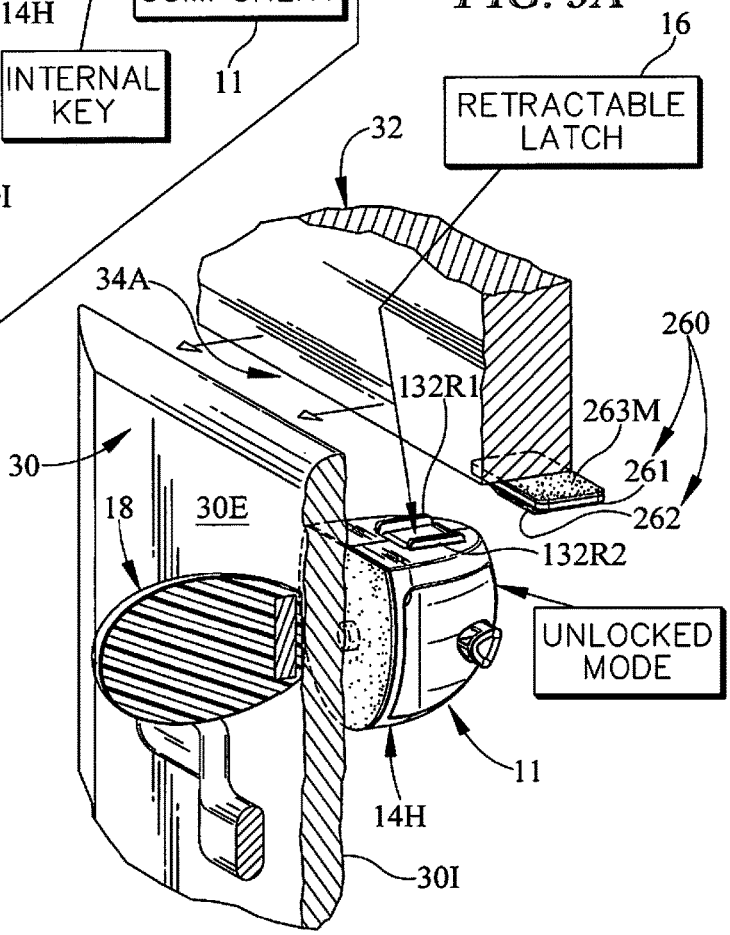
FIG. 4 is a view similar to FIG. 3 showing the magnetic lock in an UNLOCKED mode while the magnetic external key is engaged to a panel of the cabinet door (or drawer) and showing that the retractable latch has been pivoted in a clockwise direction to assume a retracted position within a housing included in the magnetic lock so as to establish the UNLOCKED mode of the magnetic lock.

Once installed, catch 26 is mounted on a cabinet frame 32 of a cabinet 34 and magnetic lock 11 is mounted on a panel 30 of a companion cabinet door (or drawer) 30D so that a retractable latch 16 included in magnetic lock 11 is extended automatically to engage catch 26 when cabinet door (or drawer) 30D is moved toward cabinet frame 32 to a CLOSED position to cause panel 30 to engage cabinet frame 32 as suggested in FIG. 3 to establish a LOCKED mode of magnetic lock 11. Then, magnetic external key 18 is mated with an exterior wall 30E of panel 30 as shown in FIG. 4 by a person that wishes to access the contents of the locked cabinet 34 to cause latch 16 to retract and move from an EXTENDED position engaging catch 26 as shown in FIG. 3 to a RETRACTED position disengaging catch 26 as shown in FIG. 4 to allow that person to open the cabinet door (or drawer) 30D. The disclosure of a cabinet security system in U.S. Pat. No. 8,397,546 granted Mar. 17, 2013 is hereby incorporated by reference herein in its entirety and such disclosure describes, for example, the function and operation of latch 16 and magnetic external key 18.

Figure 2:
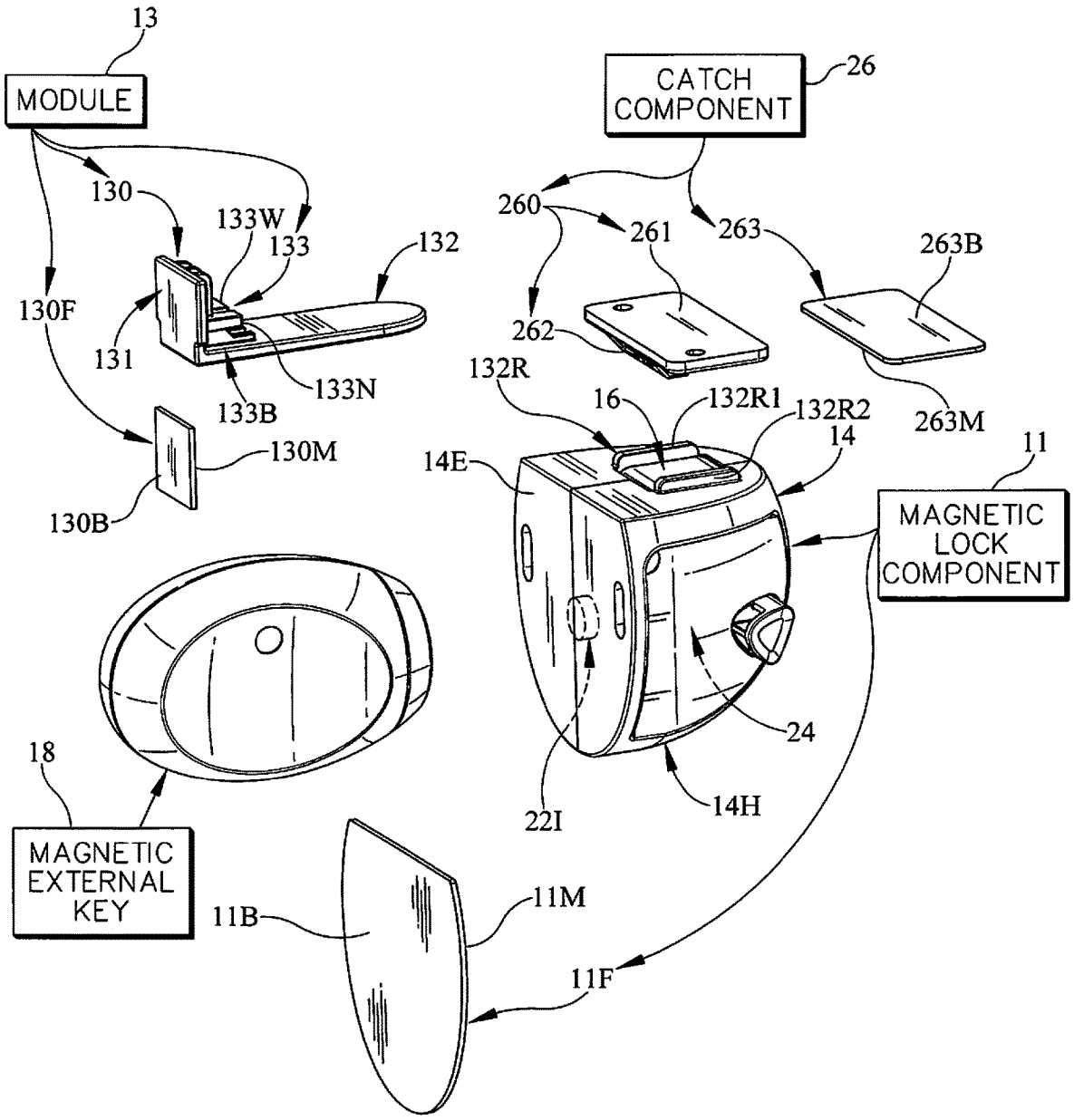
FIG. 2 is an exploded perspective view of some of cabinet security system components shown in FIG. 1 and shows that (1) the discardable dual-component installation-alignment module comprises an L-shaped alignment template, a catch support cantilevered to the L-shaped alignment template, and a small rectangular adhesive template fastener, (2) the catch component comprises a latch lip, catch plate, and a medium-sized adhesive catch-plate fastener, and (3) the magnetic lock component comprises a lock unit and a large-sized adhesive lock-unit fastener, and also shows the magnetic external key shown in FIG. 1.

Magnetic lock 11 includes a lock unit 15 that comprises an actuator housing 14H and a latch actuator 24 coupled to latch 16 and located inside actuator housing 14H as suggested in FIG. 2. Latch actuator 24 includes an internal magnet 221 located inside actuator housing 14H and arranged to communicate magnetically with magnetic external key 18 to establish an UNLOCKED mode of magnetic lock 11 when magnetic external key 18 is mated with an exterior surface 30E of panel 30 of cabinet door (or drawer) 30D as shown, for example, in FIG. 4.

Figure 5:
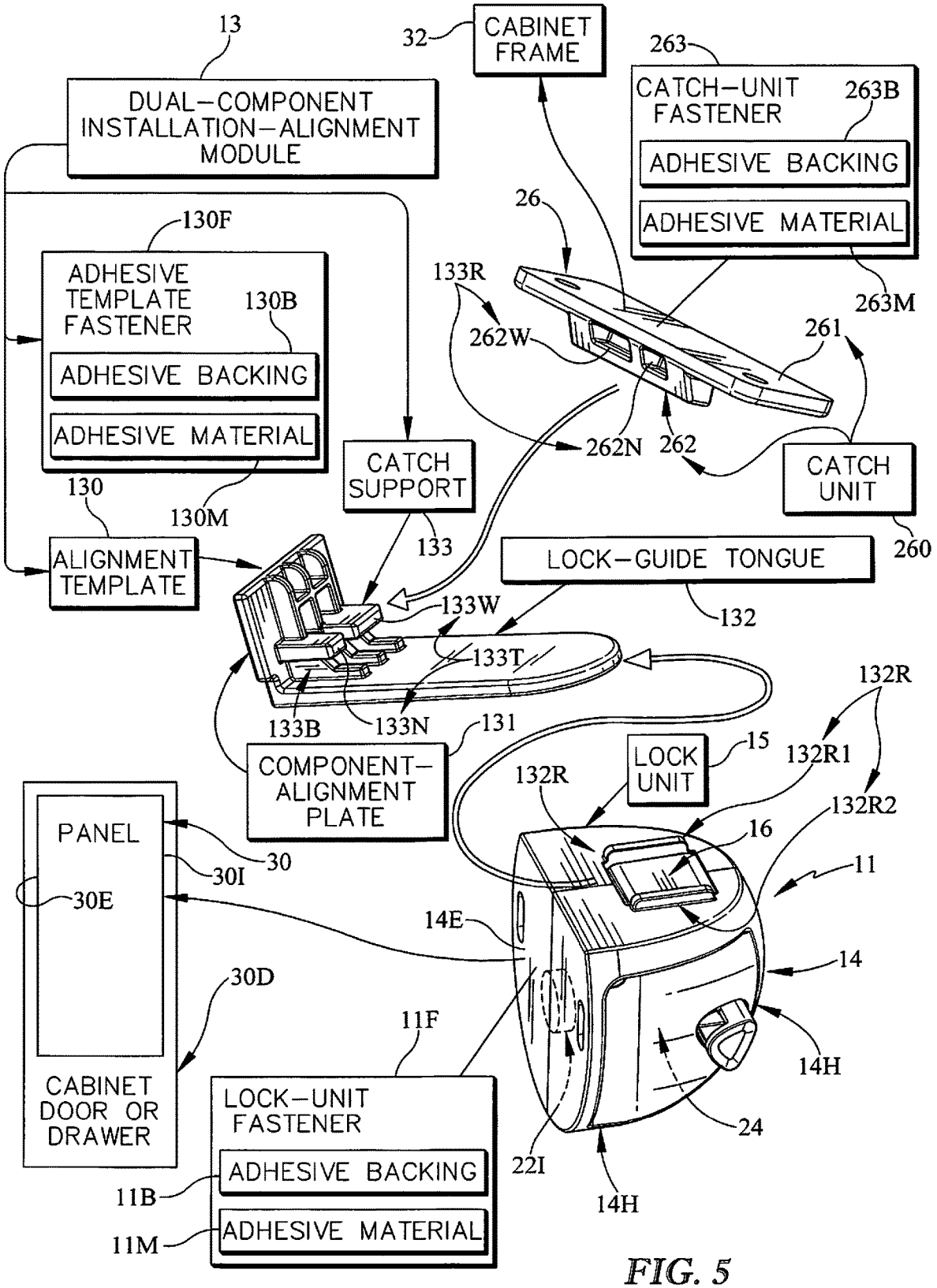
FIG. 5 is an enlarged perspective view of the L-shaped template of the discardable dual-component installation-alignment module, the catch component, and the magnetic lock component, and showing that the catch includes a catch unit and a catch-unit fastener, and showing that the catch unit comprises a catch plate for mating with the cabinet frame, a latch lip coupled to an underside of the catch plate for engaging a retractable latch in the magnetic lock during lock use and for engaging a two-prong catch support included in the L-shaped alignment template during catch installation, and showing that a tongue receiver is provided on top of a lock unit of the magnetic lock that is configured to be held manually by a lock installer and slidably aligned with the lock-guide tongue included in the L-shaped alignment template, and also suggesting that during installation of the cabinet security system on the cabinet: (1) an upwardly facing surface of the catch plate will be mounted an the cabinet frame and (2) each of an outer surface of a component-alignment plate included in the L-shaped alignment template and a vertical panel-engagement surface of the lock unit will be mounted on the interior wall of the panel of the cabinet door (or drawer) using adhesive material included in the lock-unit fastener.

Magnetic lock 11 also includes an adhesive lock-unit fastener 11F comprising an adhesive material 11M and an adhesive backing 11B as suggested in FIGS. 2 and 5. Adhesive material 11M is coupled to an external face 14E of actuator housing 14H of lock unit 15 to locate external face 14E between adhesive material 120M and internal magnet 221 as suggested in FIGS. 1 and 2. Dual-component installation-alignment module 13 is used in accordance with the present disclosure to position external face 14E of actuator housing 14H on an inner surface 301 of panel 30 of cabinet door (or drawer) 30D as suggested diagrammatically in FIG. 6 and illustratively in FIGS. 12 and 13. Once actuator housing 14H of magnetic lock 11 is mounted in a proper position on an inner surface 301 of panel 30 of cabinet door (or drawer) 30 using adhesive material 120M to align with the companion catch 26 when cabinet door (or drawer) 30 is closed, then other suitable fasteners such as screws (not shown) could be used to retain actuator housing 14H in a stationary position on panel 30.

Catch 26 when mounted on a top strip 31 of cabinet frame 32 functions as a latch blocker to block movement of latch 26 of magnetic lock 11 away from cabinet frame 32 when cabinet door (or drawer) 30D is closed unless the magnetic lock 11 is changed from LOCKED mode shown in FIG. 3 to UNLOCKED mode using magnetic external key 18 as shown in FIG. 4. Catch 26 includes a catch unit 260 and an adhesive catch-unit fastener 263 as shown, for example, in FIG. 5. Catch unit 260 comprises a catch plate 261 for mounting on cabinet frame 32 and a latch lip 262 for engaging latch 16. Adhesive catch fastener 263 comprises an adhesive material 263M adhered to catch plate 261 and an adhesive backing 263B coupled to an outer surface of adhesive material 263M, as suggested in FIGS. 2 and 5.

Figure 6:
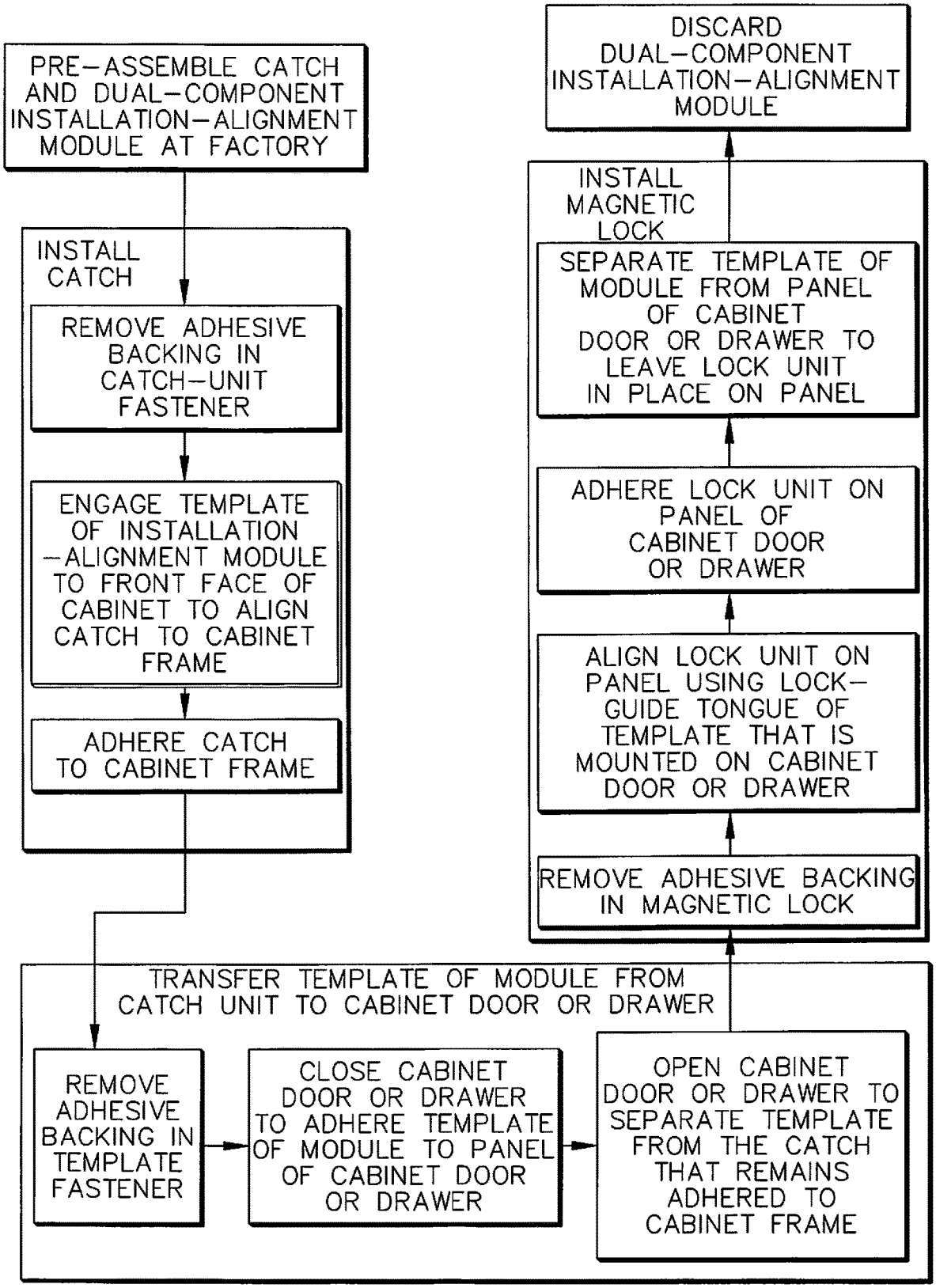
FIG. 6 is a system installation flow chart illustrating an installation sequence for the cabinet security system comprising a catch-component installation step using the catch support in the discardable dual-component installation-alignment module, followed by temporary mounting of the dual-component installation-alignment module on a panel of the cabinet door (or drawer), and then followed by a magnetic-lock-component installation step using the lock-guide tongue in the discardable dual-component installation-alignment module, and later followed by discard of the installation-alignment module.

Dual-component installation-alignment module 13 is used in accordance with the present disclosure to position catch plate 261 of catch 26 on top strip 31 of cabinet frame 32 as suggested in FIG. 6 and in FIGS. 7-10. The installer can remove the adhesive backing 263B to expose the adhesive material 263M to the top strip 31 of cabinet frame 32. Once catch plate 261 is mounted on top strip 31 of cabinet frame 32 using adhesive material 263M of adhesive catch fastener 263 other fasteners such as screws (not shown) can be used to retain catch unit 260 in a stationary position on top strip 31.

Dual-component installation-alignment module 13 comprises an alignment template 130 and a small adhesive template fastener 130F as shown in FIGS. 1 and 2. Alignment template 130 is L-shaped in illustrative embodiments of the present disclosure. L-shaped alignment template 130 includes a short vertical component-alignment plate 131 and a relatively longer horizontal lock-guide tongue 132 cantilevered to a lower end of vertical component-alignment plate 131. Installation-alignment module 13 also includes a catch support 133 comprising a tab rigidifier and a catch-alignment tab 133T coupled to a middle portion of vertical component-alignment plate 131 and arranged to lie above and in spaced-apart relation to the underlying horizontal lock-guide tongue 132, as shown, for example, in FIGS. 2 and 5. Tab rigidifier 133B is coupled to catch-alignment tab 133T, component-alignment plate 131, and lock-guide tongue 132 in illustrative embodiments. Small adhesive template fastener 130F comprises an adhesive material 130M and an adhesive backing 130B on the adhesive material 130M as suggested in FIGS. 2 and 5. Adhesive material 130M is adhered to an outer surface of component-alignment plate 131 as suggested in FIG. 5.

In illustrative embodiments, component-alignment plate 131 of L-shaped alignment template 130 includes an outer surface facing away from the cantilevered lock-guide tongue 132 and an inner surface facing toward the cantilevered lock-guide tongue 132 as suggested in FIGS. 2 and 5. The inner surface of the component-alignment plate 131 is arranged to be located on cabinet frame 32 as suggested in FIG. 10 to position catch 26 properly on the cabinet frame 32 during catch installation. Catch-alignment tab 133T is cantilevered to the inner surface of component-alignment plate 131 and arranged to lie in spaced-apart relation to lock-guide tongue 132 as shown in FIG. 5. The adhesive template fastener 130F is coupled to the outer surface of the short component-alignment plate 131 and arranged to be adhered to the cabinet door panel 30 during magnetic lock installation as suggested in FIG. 13. The cantilevered lock-guide tongue 132 is configured to mate with and guide magnetic lock 11 without holding magnetic lock 11 to assume a proper position on the cabinet door panel 30 that is aligned with the catch 26 mounted on cabinet frame 32 when the outer surface of component-alignment plate 131 is adhered to the cabinet door panel 30 using the adhesive template fastener 130F as suggested in FIG. 13.

Catch-alignment tab 133T of dual-component installation-alignment module 13 is configured to extend into a tab receiver 133R formed in latch lip 262 of catch 26 as suggested in FIGS. 1, 5, 7, and 8. Then dual-component installation-alignment module 13 can be used by an installer to transport catch component 26 to be mounted on top strip 31 of cabinet frame 32 as suggested in FIGS. 9 and 10. In an illustrative embodiment shown in FIG. 5, catch-alignment tab 133T of catch support 133 is two pronged and comprises a narrow prong 133N and a relatively wider wide prong 133W arranged to lie in side-by-side laterally spaced-apart relation to the narrow prong 133N. Narrow prong 133N is sized to extend into a companion narrow-prong receiver 262N of tab receiver 133R formed in latch lip 262 of catch 26 as suggested in FIGS. 5 and 7. Wide prong 133W is sized to extend into a companion wide-prong receiver 262W of tab receiver 133R formed in latch lip 262 of catch 26 and arranged to lie in laterally spaced-apart relation to narrow-prong receiver 262N.

Lock-guide tongue 132 of L-shaped alignment template 130 of dual-component installation-alignment module 13 is configured to extend into a tongue receiver 132R coupled to a top surface of actuator housing 14H of lock unit 15 while lock unit 15 is being held by a lock installer without holding or supporting lock unit 15 on lock-guide tongue 132 as suggested in FIGS. 1 and 5. Tongue receiver 132R includes a first tongue-guide rib 132R1 and a laterally spaced-apart second tongue-guide rib 132R2 as shown in FIG. 5. Retractable latch 16 is arranged to lie between and move relative to tongue-retainer ribs 132R1, 132R2 as magnetic lock 14 is changed from LOCKED mode to UNLOCKED mode as suggested in FIGS. 3A and 4. Once the dual-component installation-alignment module 13 is mounted in a proper position on panel 30 of cabinet door (or drawer) 30D to align with the catch 26 mounted on cabinet frame 32, then magnetic lock 14 is moved by an installer toward the mounted dual-component installation-alignment module 13 to engage lock-guide tongue 132 and tongue receiver 132R so that magnetic lock 11 is aligned with lock-guide tongue 132 as suggested in FIGS. 1 and 13.

Cabinet security system 10 comprises catch component 26 and a magnetic lock component 14 as suggested in FIGS. 1 and 5. Catch component 26 is configured to be secured to a cabinet frame 32 or other stationary portion of a cabinet 34 to provide means for preventing cabinet door or drawer 30D from opening when a latch 16 included in magnetic lock 11 engages catch 26. Magnetic lock component 11 is configured to be secured to an inside surface 301 of a movable cabinet door (or drawer) 30D.

In an illustrative embodiment, latch 16 is coupled to a latch actuator 24 so that it can retract inside an actuator housing 14H as shown in FIGS. 4 and 5 to disengage latch lip 262 of catch 26 and extend outside of actuator housing 14H as shown in FIG. 3 to engage latch lip 262 of catch 26 when cabinet door (or drawer) 30D is closed to engage cabinet frame 32.

In an illustrative embodiment, lock component 11 is a magnetic lock in which the latch actuator 24 includes a magnet 221. When a magnetic external key 18 is place on an outside surface 30E of the cabinet door or drawer 30D to communicate magnetically with magnet 221, latch actuator 24 is moved inside actuator housing 14H to retract latch 16 to assume a position inside actuator housing 14H and disengage catch 26 as shown in FIG. 4 so as to permit movement of cabinet door (or drawer) 30D relative to the stationary cabinet frame 32.

The dual-component installation-alignment module 13 includes an alignment template 130 that is configured to interact or engage with the lock component 11 and the catch component 26 during installation to ensure that the catch component 26 and the lock component 11 are aligned properly for operation. Difficulty of installation is a concern for consumers using such cabinet locks, as successful installation requires both vertical and horizontal alignment of both the lock component 11 and the catch component 26.

Alignment template 130 is used as follows in accordance with the present disclosure. The catch-support tab 133T of alignment template 13 fits into the tab receiver 133R formed in catch unit 260 as suggested in FIGS. 5, 7, and 8. Tab 133T and tab receiver 133R are configured and cooperate to prevent a user from installing catch 26 on cabinet frame 32 in a location that is too far from the edge of the cabinet door (or drawer) 30D by using component-alignment plate 131 to provide a stop against the front of cabinet frame 32.

Once catch 26 is installed on cabinet frame 32, the adhesive backing 130B on alignment template 130 is removed. Cabinet door/drawer 30D is then closed causing the exposed adhesive material 130M on adhesive template fastener 130F to adhere to inner surface 301 of cabinet door/drawer 30D as suggested in FIGS. 12 and 13.

Figure 13:
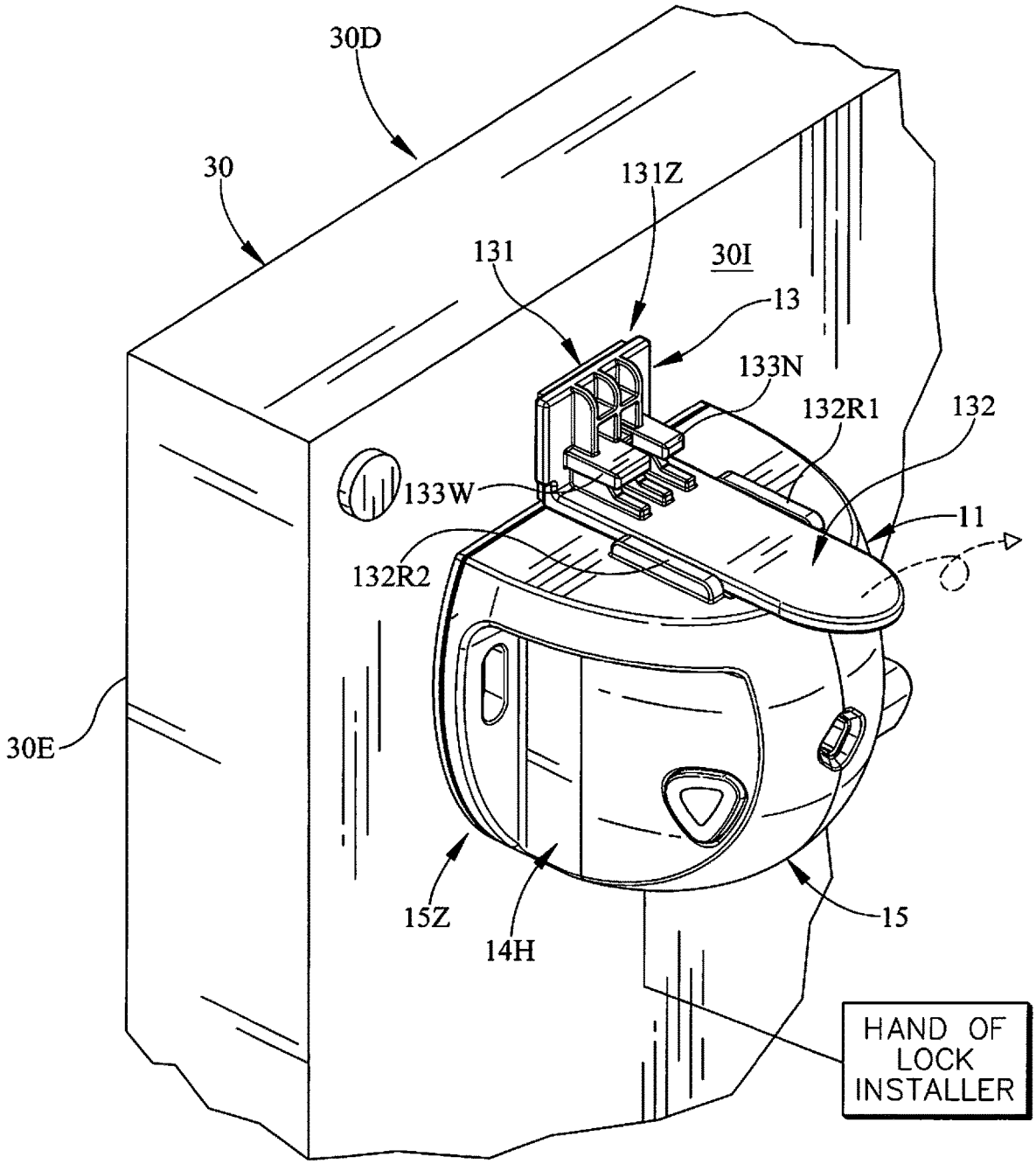

Next, cabinet door/drawer 30D is opened with the alignment template 130 now adhered to the inner surface 301 of cabinet door/drawer 30D as suggested in FIG. 13 the alignment template 130 is moved to separate from catch 26. Then magnetic lock 14 is moved by a lock installer to engage alignment template 130 as shown in FIG. 13 so that magnetic lock 11 is aligned properly with catch 26.

Figure 7:
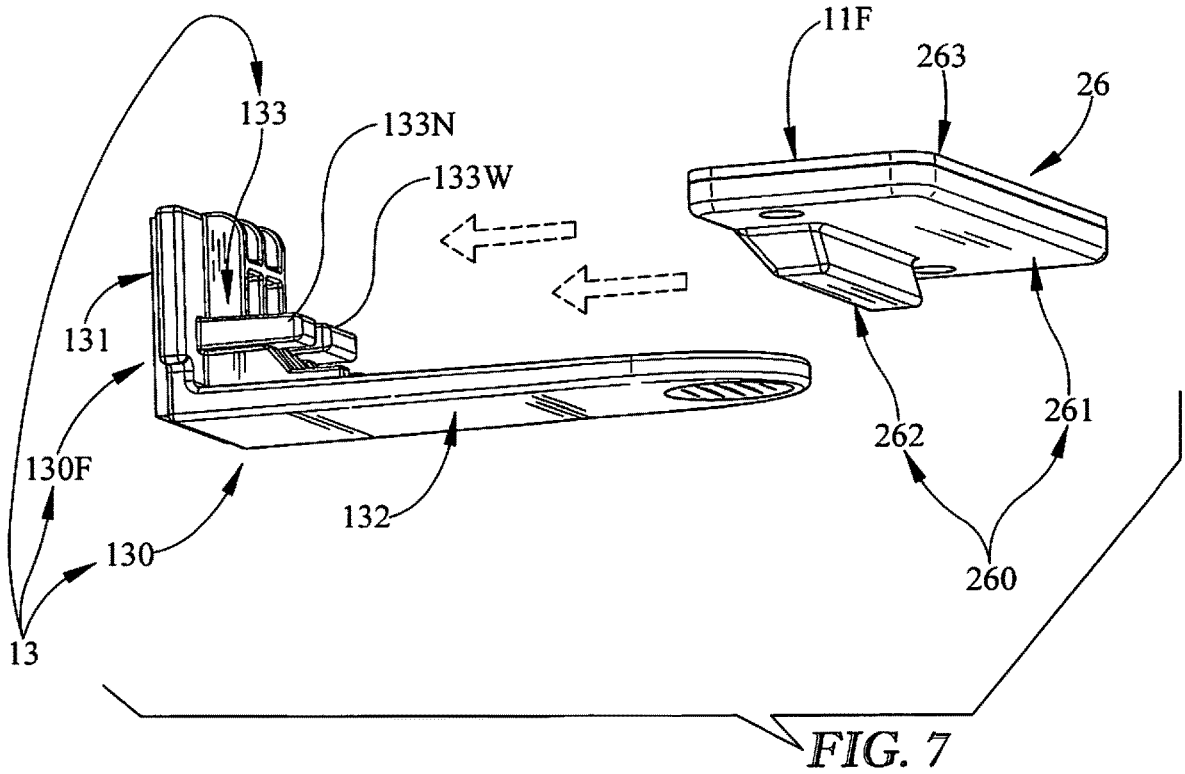
FIG. 7-13 show steps in an illustrative installation sequence of two components—a catch and a magnetic lock—for the cabinet security system shown in FIGS. 1 and 2.
Figure 8:
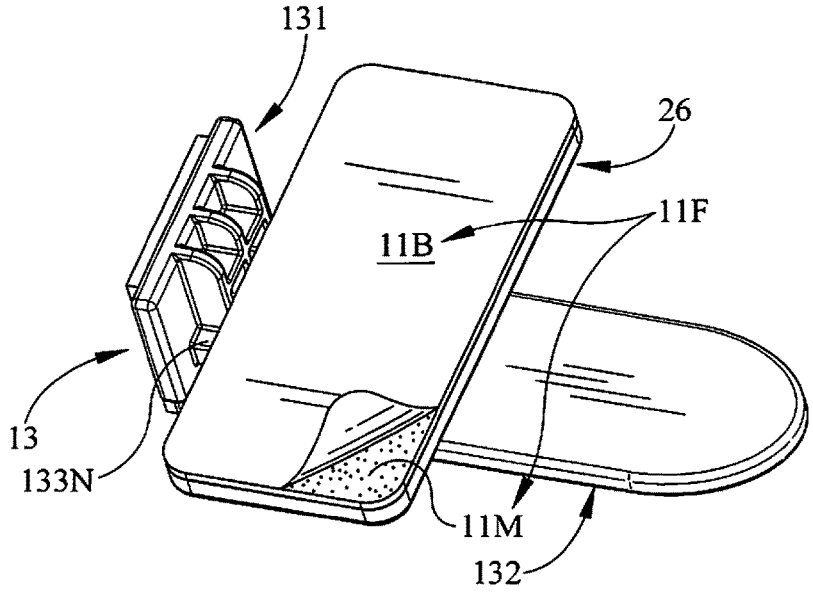
Figure 9:
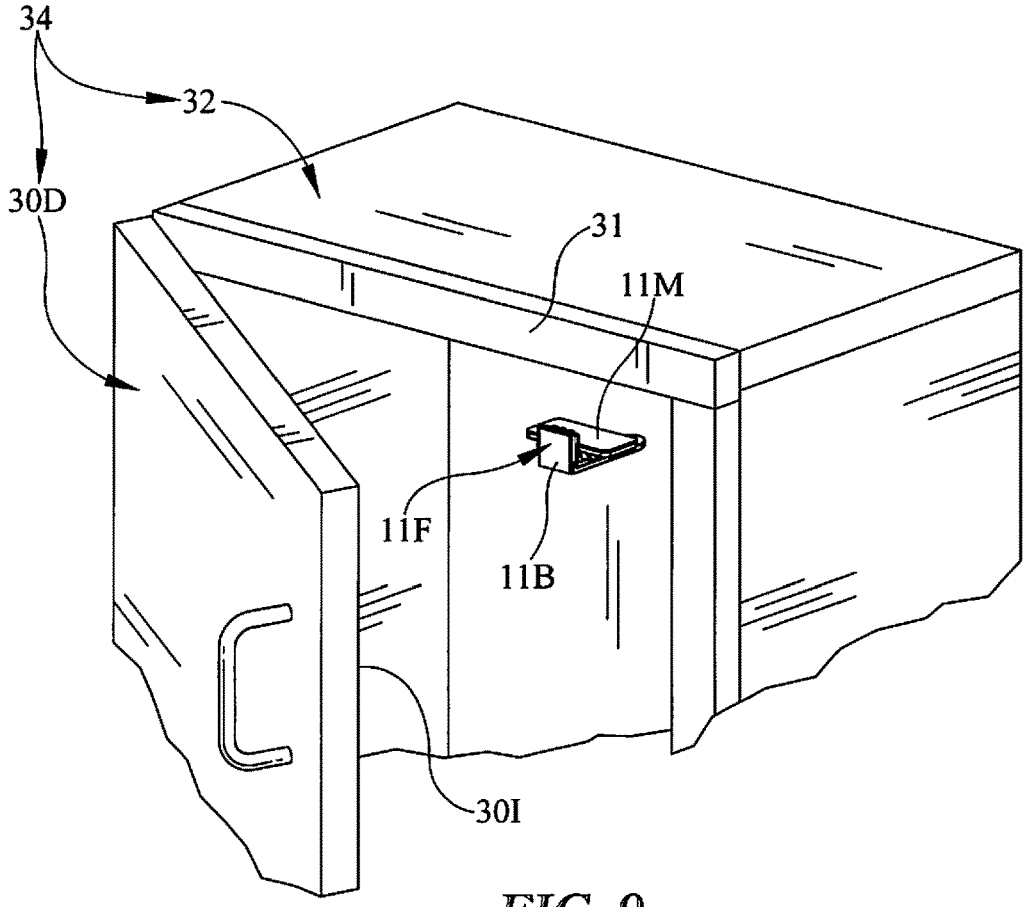
Figure 10:
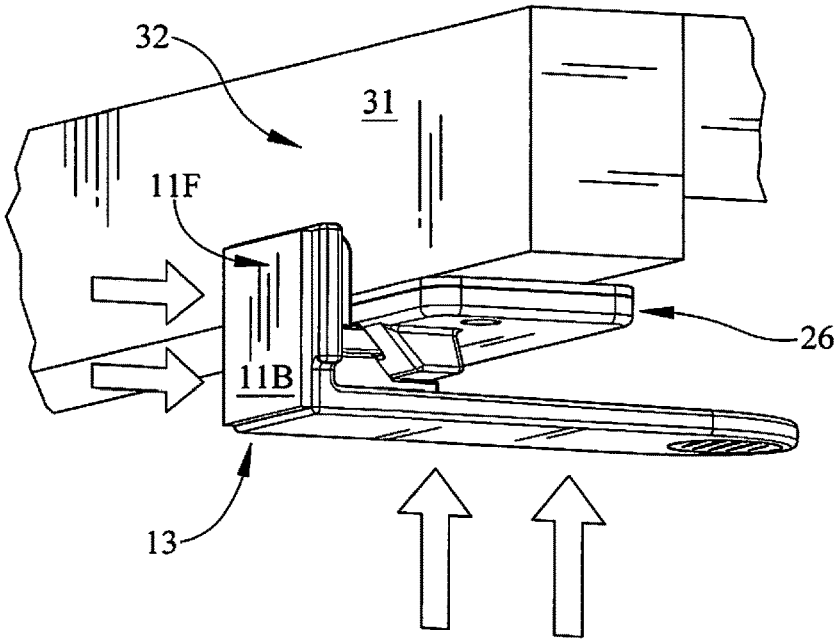

During installation, the catch 26 and alignment template 130 would illustratively come preassembled together as suggested in FIGS. 7 and 8. A user would first remove adhesive backing 263B attached to the catch component 26 to install the catch plate 261 on the cabinet frame 32 together with the alignment template 130 as shown in FIGS. 9 and 10. In various embodiments in accordance with the present disclosure, alignment template 130 is L-shaped and configured such that it interacts with the cabinet 34 in some manner to ensure that the catch 26 is installed to be flush with the face of the cabinet frame 32 as shown in FIG. 10. The alignment template 130 may further include its own adhesive backing 130B on a face of the alignment template 130 that is directed toward the movable drawer or door 30D.

Once the catch component 26 is installed on the cabinet frame 32, the template adhesive backing 130B is then removed and the door/drawer 30D is moved to a closed position, thereby allowing the template adhesive material 130M to stick to the door/drawer 30D as shown in FIG. 13. As suggested in FIGS. 11-13, when the cabinet door/drawer 30D is reopened, the force of the opening causes the alignment template 130 to separate from engagement with the mounted catch 26 and stay connected to the door/drawer 30D via the adhesive template material 130M.

To finish installation, a user would remove the adhesive backing 11B from the lock component 14 of magnetic look 11. A top surface of the lock component 14 includes one or more lock-locating ribs 132R1, 132R2 which are configured to engage with the side surfaces of lock-guide tongue 132 of the alignment template 130 to align the lock component 14 relative to the alignment template 130 while lock component 14 is held in place manually by a lock installer. In various embodiments, these lock-locating ribs 132R1, 132R2 may be on either side of the lock-guide tongue 132 and the L-shaped template 130 may include a panel that engages with or presses down on the lock-guide tongue 132 while the lock component 14 abuts again the alignment template 130 to retract the lock-guide tongue 132 from its EXTENDED position. The lock component 14 may slide into the alignment template 130 between the lock-locating ribs 132R1, 132R2, and a user can press the lock component 14 onto the inner surface 301 of the door 30D below the alignment template 130, which causes the lock component 14 to be secured to the inner surface 301 of the door 30D via the adhesive material 11M.

During installation, the alignment template 130 is never attached to both the lock component 14 and the catch component 26 at the same time. Further the lock component 14 is not retained on or coupled to the alignment template 130 during the process of installing the lock component 14 onto the inner surface 301 of the door 30D (i.e. the lock component 14 would fall to the ground if not held against the alignment template 130 manually by a user or retained against the door/drawer 30D by adhesive material 11M on the lock component 14). Accordingly, the alignment template 130 is not secured permanently to the lock component 14 and can be removed from its alignment with the lock-locating ribs 132R1, 132R2 once the lock component 14 is adhered to the door/drawer 30D. After installation of the lock component 14 onto the inner surface 301 of the door 30D, the alignment template 130 is pulled off the cabinet door/drawer 30D (e.g. the adhesive material 11M on the alignment template 130 is weak enough to permit it to be pulled off with relatively little effort), and the lock-guide tongue 132 is then biased back to its extended position where it can engage with the latch lip 262 of the catch component 26 when the door/drawer 30D is moved toward the cabinet frame 32, locking the cabinet 34 closed. In use, lock component 14 is not located by sliding on an end of alignment template 130 when catch component 26 is inserted into a slot of alignment template 130. Lock component 14 and catch component 26 are not connected to alignment template 130 at the same time.

A cabinet security system 10 in accordance with the present disclosure includes a catch 26, a magnetic external key 18, a magnetic lock 11, and a discardable dual-component installation-alignment module 13 as shown in FIG. 1. A lock installer uses installation-alignment module 13 for mounting catch 26 on a cabinet frame 32 and subsequently mounting magnetic lock 11 on a movable cabinet panel 30 associated with cabinet frame 32 using an illustrative process in accordance with the present disclosure as shown in FIGS. 7-13.

Catch 26 includes a catch unit 260 having a latch lip 262 and a catch-unit fastener 263 that is coupled to catch unit 260 as suggested in FIGS. 2 and 5. Catch-unit fastener 263 is adapted to retain catch unit 263 in a stationary position on a top strip 31 of a cabinet frame 32 that is included in a cabinet 34 and that is formed to include a cabinet aperture 34A opening into an interior region of cabinet 34 as suggested in FIGS. 3 and 12.

Magnetic external key 18 is separated from cabinet 34 as shown in FIG. 1. Magnetic external key 18 is adapted to mate with an exterior wall 30E of a movable cabinet panel 30 included in cabinet 34 as suggested in FIG. 4. The movable cabinet panel 30 is mounted for movement relative to cabinet frame 32 between an OPENED position opening the aperture 34A formed in cabinet frame 32 and a CLOSED position closing the aperture 34A formed in cabinet frame 32 as suggested in FIGS. 3 and 4.

Magnetic lock 11 includes a lock unit 15 and a lock-unit fastener 11F as suggested in FIG. 5. Lock unit 15 includes an internal magnet 221 that is responsive to the magnetic external key 18. Lock-unit fastener 11F is coupled to lock unit 15 and adapted to retain lock unit 15 in a stationary position on an opposite interior wall 301 of the movable cabinet panel 30 to allow a retractable latch 16 included in lock unit 15 to move to an EXTENDED position to engage latch lip 262 of catch unit 260 when the movable cabinet panel 30 is moved to the CLOSED position so as to retain the movable cabinet panel 30 in the CLOSED position closing the cabinet aperture 34A formed in cabinet frame 32 as suggested in FIGS. 3 and 3A.

The discardable dual-component installation-alignment module 13 is configured to mate with each of catch unit 260 and lock unit 15 as suggested in FIG. 5. Installation-alignment module 13 is separable initially from catch unit 260 after catch unit 260 is initially retained in a stationary position on top strip 31 of cabinet frame 32 as suggested in FIG. 12. Installation-alignment module 13 is later separable from lock unit 15 after lock unit 15 is subsequently retained in a stationary position on the opposite interior wall 301 of the movable cabinet panel 30 as suggested in FIG. 13.

The discardable dual-component installation-alignment module 13 comprises an alignment template 130 and a catch support 133 as shown in FIG. 5. Alignment template 130 is associated with the movable cabinet panel 30 and the lock unit 15. Catch support 133 is coupled to alignment template 130 and associated with cabinet frame 32 and catch unit 260.

Alignment template 130 includes a component-alignment plate 131 and a lock-guide tongue 132 as shown in FIGS. 1, 2, and 5. Component-alignment plate 131 is adapted to be mounted in a template-mounting zone 1317 provided on the opposite interior wall 301 of the movable cabinet panel 30 as suggested in FIG. 13. Lock-guide tongue 132 is coupled to component-alignment plate 131 to move therewith relative to cabinet 34 during installation of catch unit 260 on top strip 31 of cabinet frame 32 and installation of lock unit 15 on opposite interior wall 301 of the movable cabinet panel 30.

Figure 11:
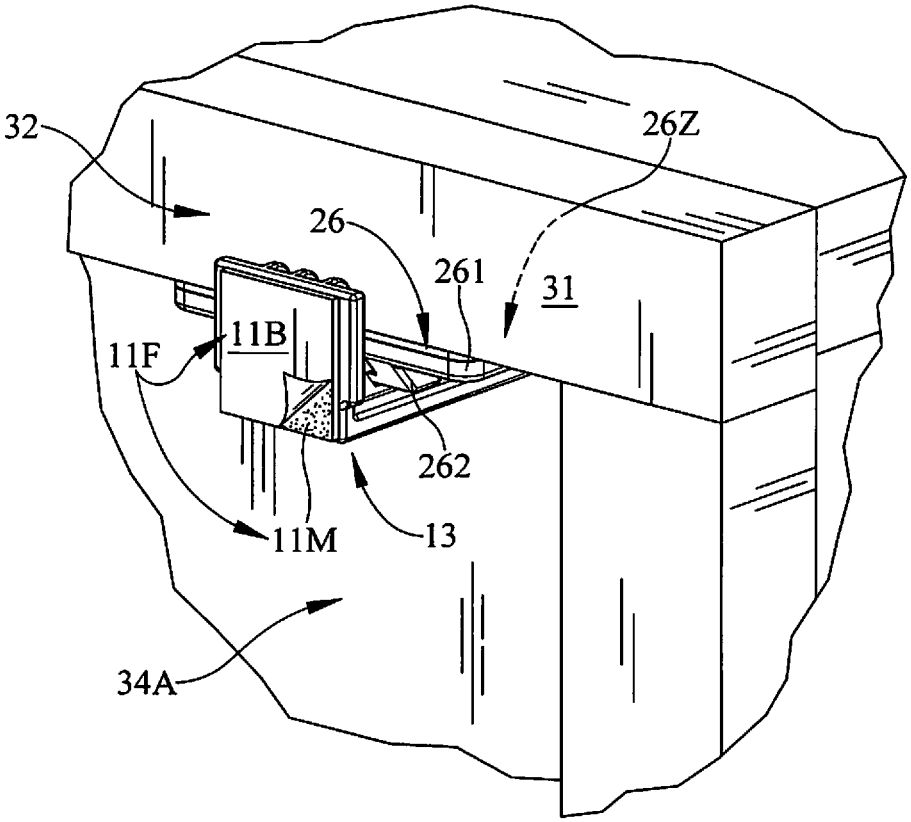

Catch support 133 includes template-positioner means 133T for temporarily engaging catch unit 260 as suggested in FIG. 11 during mounting of catch unit 260 in a stationary latch-engaging position on top strip 31 of cabinet frame 32 to cause lock-guide tongue 132 to be aligned with and arranged to lie under catch unit 260 after catch unit 260 is mounted in the stationary latch-engaging position. This causes component-alignment plate 131 of alignment template 130 subsequently to be aligned with the template-mounting zone 1317 provided on the opposite interior wall 301 of the movable cabinet panel 30 when the movable cabinet panel 30 is moved to the CLOSED position as suggested in FIG. 12.

Lock unit 15 includes an actuator housing 14H as shown in FIG. 5. Actuator housing 14H is adapted to be retained in a stationary mounted position on the opposite interior wall 301 of the movable cabinet panel 30 in a lock-mounting zone 157 that is positioned on the opposite interior wall 301 of the movable cabinet panel 30 to lie adjacent to template-mounting zone 1317 as suggested in FIG. 13.

Lock unit 15 further includes tongue-receiver means 132R on actuator housing 14H for receiving lock-guide tongue 132 of alignment template 13 therein as suggested in FIG. 5 after component-alignment plate 131 of alignment template 130 has been fixed in a stationary position in the template-mounting zone 1317 of the opposite interior wall 301 of the movable cabinet panel 30 and after catch 26 has been separated from the template-positioner means of catch support 260 of alignment template 130 during subsequent movement of the movable cabinet panel 30 from the CLOSED position to the OPENED position so that lock unit 15 is aligned with latch lip 262 of catch 26 each time the movable cabinet panel 30 is moved from the OPENED position to the CLOSED position.

Catch unit 260 further includes a catch plate 261 that is coupled to latch lip 262 as suggested in FIG. 5. Catch plate 261 is arranged to confront top strip 31 of cabinet frame 32 as suggested in FIG. 11. Catch-unit fastener 263 is coupled to catch plate 261 and arranged to mate with top strip of cabinet frame 32 to retain catch plate 261 and latch lip 262 in a stationary position on top strip 31 of the cabinet frame 32.

Catch support 133 is coupled to component-alignment plate 131 of alignment template 130 and arranged to lie above lock-guide tongue 132 of alignment template 130 as shown in FIG. 5. Catch support 133 is formed to include the template-positioner means 133T.

Latch lip 262 is formed to include a prong receiver 262N or 262W as shown in FIG. 5. The template-positioner means includes a prong 133N or 133W that is coupled to component-alignment plate 131 and arranged to extend into the prong receiver 262N or 262W formed in latch lip 262 of catch 26 as suggested in FIG. 5.

The template-positioner means of catch support 133 comprises a catch-alignment tab 133T that is coupled to and arranged to extend in perpendicular relation to component-alignment plate 131 as suggested in FIG. 5. Latch lip 262 of catch 26 is formed to include a tab receiver 133R sized to receive a free end of catch-alignment tab 133T when catch 26 is coupled temporarily to catch support 133.

Tab receiver 133R comprises a narrow-prong receiver 262N and a wide-prong receiver 262W that each open toward component-alignment plate 131 when catch 26 is coupled temporarily to catch support 133 as suggested in FIG. 5. Catch-alignment tab 133T comprises a narrow prong 133N associated with narrow-prong receiver 262N and a relatively wider wide prong 133N associated with wide-prong receiver 262W and arranged to lie in side-by-side laterally spaced-apart relation to the narrow prong 262N.

Catch support 133 further comprises a tab rigidifier 133T coupled to a proximate end of catch-alignment tab 133T and to lock-guide tongue 132 of alignment template 130 to rigidify catch-alignment tab 133T as suggested in FIG. 5. Tab rigidifier 133T is also coupled to component-alignment plate 131 of alignment template 13.

Alignment template 130 is L-shaped as suggested in FIG. 5. Component-alignment plate 131 has an inner surface that mates with cabinet frame 32 when the template-positioner means 133T temporarily engages the catch unit 260 as suggested in FIG. 12. Component-alignment plate 131 also has an opposite outer surface that mates with the opposite interior wall 301 of the movable cabinet panel 30 as suggested in FIG. 13 to facilitate retaining actuator housing 14H in the stationary mounted position on the opposite interior wall 301 of the movable cabinet panel 30.

The tongue-receiver means 132R comprises a first tongue-guide rib 132R1 and a laterally spaced-apart second tongue-guide rib 132R that cooperates with the first tongue-guide rib 132R1 to receive the lock-guide tongue 132 of alignment template 130 therein as suggested in FIGS. 5 and 13. The retractable latch 16 is arranged to extend outwardly between the first and second tongue-guide ribs 132R1, 132R2 when the retractable latch 16 is moved to assume the EXTENDED position.

A process is disclosed herein for mounting a magnetic lock 11 in a stationary position in a mounting zone provided on an interior wall 301 of a cabinet panel 30 of a cabinet door or drawer 30D to align a retractable latch 16 included in magnetic lock 11 with a catch 26 mounted on a frame 32 of a cabinet 34 so that the retractable latch 16 extends to mate with catch 26 when cabinet panel 30 is moved relative to cabinet frame 32 to close an aperture 34A opening into an interior region of cabinet 34 as suggested diagrammatically in FIG. 6 and illustratively in FIGS. 7-13. The process comprises the initial steps of providing a discardable dual-component installation-alignment module 13 comprising an alignment template 130 and a catch support 133 attached to alignment template 130 and moving an assembly comprising the discardable dual-component installation-alignment module 13 and a catch 26 coupled temporarily to catch support 133 of the discardable dual-component installation-alignment module 13 toward cabinet frame 32 of cabinet 34 to cause a component-alignment plate 131 included in alignment template 130 to engage cabinet frame 34 to locate catch 26 in alignment with and closely confronting relation to a catch-mounting zone 262 on cabinet frame 34 as suggested in FIGS. 11 and 12 while a cabinet panel 30 of a cabinet door or drawer 30D associated with cabinet frame 34 remains in an OPENED position to expose a cabinet aperture 34A opening into an interior region of the cabinet 34.

The process further comprises the steps of mounting catch 26 in a stationary latch-engaging position on the catch-mounting zone 267 on cabinet frame 32 while cabinet panel 30 remains in the OPENED position and subsequently moving cabinet panel 30 relative to cabinet frame 32 from the OPENED position to a CLOSED position closing cabinet aperture as suggested in FIG. 12 to cause alignment template 130 to adhere to an interior wall 301 of the cabinet panel 30 that is arranged to face toward the interior region of cabinet 34 while catch 26 is mounted in the stationary latch-engaging position on the catch-mounting zone on cabinet frame 34 and catch 26 remains coupled temporarily to the catch support 133 that is attached to alignment template 130 as suggested in FIG. 13.

The process still further comprises the steps of subsequently moving cabinet panel 30 relative to cabinet frame 34 from the CLOSED position to the OPENED position while component-alignment plate 131 of alignment template 130 is adhered to interior wall 301 of cabinet panel 30 as suggested in FIG. 6 this motion separates catch support 260 of the discardable dual-component installation-alignment module 13 from the catch 26 that remains in the stationary latch-engaging position on cabinet frame 34 as suggested in FIG. 13.

The process still further comprises the steps of subsequently engaging a magnetic lock 11 temporarily with a lock-guide tongue 132 included in alignment template 130 of the discardable dual-component installation-alignment module 13 as suggested in FIGS. 6 and 13 while cabinet panel 30 remains in the OPENED position to locate lock unit 15 of magnetic lock 11 in alignment with and closely confronting relation to a lock-mounting zone 157 on interior wall 301 of cabinet panel 30 and subsequently mounting lock unit 15 of magnetic 11 lock on the lock-mounting zone 157 on interior wall 301 of cabinet panel 30 while magnetic lock 11 remains engaged temporarily with lock-guide tongue 132 of alignment template 13. The process also comprises the steps of subsequently separating component-alignment plate 131 of alignment template 130 of the discardable dual-component installation-alignment module 13 from interior wall 301 of cabinet panel 30 and from magnetic lock 11 as suggested in FIG. 6 to leave magnetic lock 11 in a stationary mounted position on interior wall 301 of cabinet panel 30 to cause a retractable latch 16 included in magnetic lock 16 to engage catch 26 when cabinet panel 30 is later moved to the CLOSED position 30 to retain cabinet panel in the CLOSED position on cabinet frame 32 of cabinet 34.

Catch 26 includes a catch plate 261 that is arranged to mate with cabinet frame 34 when catch 26 is mounted on the catch-mounting zone 267 on cabinet frame 34 as suggested in FIG. 2. Catch 26 also includes a latch lip 262 that is coupled to catch plate 261. Latch lip 262 is arranged to engage the retractable latch 16 of magnetic lock 11 after alignment template 130 of the discardable dual-component installation-alignment module 13 has been separated from interior wall 301 of cabinet panel and magnetic lock 11 and cabinet panel 30 has been moved subsequently to the CLOSED position. Latch lip 262 is configured to mate with the catch support 133 included in the discardable dual-component installation-alignment module 13 to couple catch 26 to catch support 133 temporarily during the "moving an assembly" step.

Catch support 133 of the discardable dual-component installation-alignment module 13 includes a catch-alignment tab 133T that extends in perpendicular relation to component-alignment plate 131 as shown in FIG. 5. Latch lip 262 is formed to include a tab receiver 133R sized to receive a free end of catch-alignment tab 133T when catch 26 is coupled temporarily to catch support 133.

Figure 12:
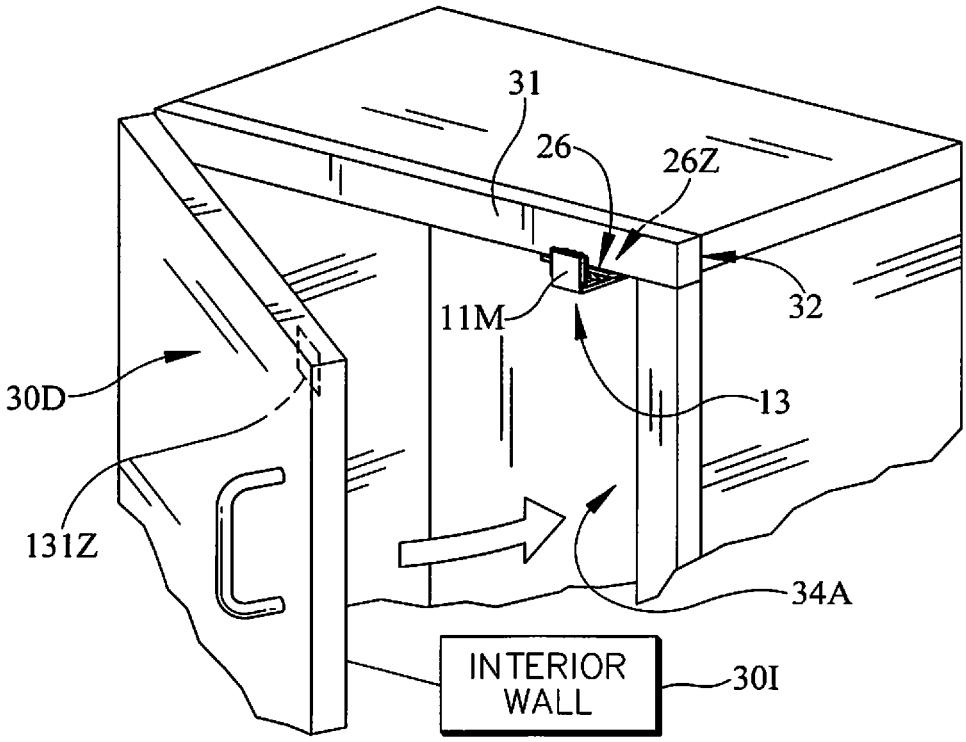

Component-alignment plate 131 has an inner surface that mates with the cabinet frame 34 during the "moving an assembly" step to locate catch plate 261 in alignment with and in closely confronting relation to the catch-mounting zone 267 on cabinet frame 34 as suggested in FIGS. 11 and 12. Component-alignment plate 131 also has an opposite outer surface that mates with interior wall 301 of cabinet panel 30 during the "moving the cabinet panel" step to orient lock-guide tongue 132 of alignment template 130 to lie in perpendicular relation to interior wall 301 of cabinet panel 30.

Magnetic lock 11 includes a tongue receiver 132R comprising a first tongue-guide rib 132R1 and a laterally spaced-apart second tongue-guide rib 132R2 as suggested in FIG. 5. Second tongue-guide rib 132R2 cooperates with first tongue-guide rib 132R1 to receive lock-guide tongue 132 of alignment template 130 of the discardable dual-component installation-alignment module 13 therebetween during the "subsequently engaging a magnetic lock" step so that magnetic lock 11 is located in alignment with and closely confronting relation to the lock-mounting zone on interior wall 301 of cabinet panel 30 and so that lock-guide tongue 132 of alignment template 130 of the discardable dual-component installation-alignment module 13 is separate from tongue receiver 132R during the "subsequently separating the component-alignment plate" step.

Figure 3A:
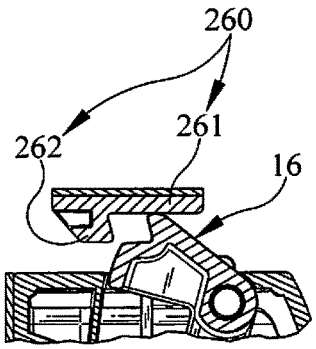
FIG. 3A is an enlarged sectional view taken along lines 3A-3A of FIG. 3 showing that a retractable latch included in the magnetic lock has been pivoted upwardly about a horizontal latch-pivot axis to engage a latch lip included in the catch to establish the LOCKED mode of the magnetic lock and block movement of the cabinet panel away from the cabinet frame.

Magnetic lock 11 includes a lock unit 15 comprising a housing 14H, a retractable latch 16 arranged to move relative to housing 14H between a RETRACTED position lying inside the housing to an EXTENDED position extending outside housing 14H, and a latch actuator comprising a magnetic external key 18 comprising an internal magnet 221 as suggested in FIGS. 3, 3A, and 5. Latch actuator 18 is configured to move the retractable latch 16 relative to housing 14H between the RETRACTED position and the EXTENDED position. The latch actuator also include an internal key 181 as suggested in FIG. 3 for operating retractable latch 16 mechanically. The retractable latch 16 is arranged to extend outwardly between first and second tongue-guide ribs 132R1, 132R2 of tongue receiver 132 when the retractable latch 16 is moved to assume the EXTENDED position so as to engage the catch 26 that is mounted on the catch-mounting zone 267 of cabinet frame 34 when the cabinet panel 30 occupies the CLOSED position.

The invention claimed is:

1. A process for mounting a magnetic lock in a stationary position in a mounting zone provided on an interior wall of a panel of a cabinet door or drawer to align a retractable latch included in the magnetic lock with a catch mounted on a frame of a cabinet so that the retractable latch extends to mate with the catch when the panel is moved relative to the cabinet to close an aperture opening into an interior region of the cabinet, the process comprising the steps of providing a discardable dual-component installation-alignment module comprising an alignment template and a catch support attached to the alignment template, moving an assembly comprising the discardable dual-component installation-alignment module and a catch coupled temporarily to the catch support of the discardable dual-component installation-alignment module toward the frame of the cabinet to cause a component-alignment plate included in the alignment template to engage the frame to locate the catch in alignment with and closely confronting relation to a catch-mounting zone on the frame while the panel of the cabinet door or drawer associated with the cabinet remains in an opened position to expose a cabinet aperture opening into an interior region of the cabinet, mounting the catch in a stationary latch-engaging position on the catch-mounting zone on the frame while the panel remains in the opened position, subsequently moving the panel relative to the frame from the opened position to a closed position closing the cabinet aperture to cause the alignment template to adhere to an interior wall of the panel that is arranged to face toward the interior region of the cabinet while the catch is mounted in the stationary latch-engaging position on the catch-mounting zone on the frame and the catch remains coupled temporarily to the catch support that is attached to the alignment template, subsequently moving the panel relative to the frame from the closed position to the opened position while the component-alignment plate of the alignment template is adhered to the interior wall of the panel to separate the catch support of the discardable dual-component installation-alignment module from the catch that remains in the stationary latch-engaging position on the frame, subsequently contacting a magnetic lock temporarily with a lock-guide tongue included in the alignment template of the discardable dual-component installation-alignment module while the panel remains in the opened position to locate the magnetic lock in alignment with and closely confronting relation to a lock-mounting zone on the interior wall of the panel, subsequently mounting the magnetic lock on the lock-mounting zone on the interior wall of the panel while the magnetic lock remains in contact temporarily with the lock-guide tongue of the alignment template, and subsequently separating the component-alignment plate of the alignment template of the discardable dual-component installation-alignment module from the interior wall of the panel and from the magnetic lock to leave the magnetic lock in a stationary mounted position on the interior wall of the panel to cause a retractable latch included in the magnetic lock to engage the catch when the panel is later moved to the closed position to retain the panel in the closed position on the frame of the cabinet.

2. The process of claim 1, wherein the catch comprises a catch plate that is arranged to mate with the frame when the catch is mounted on the catch-mounting zone on the frame and a latch lip that is coupled to the catch plate and arranged to engage the retractable latch of the magnetic lock after the alignment template of the discardable dual-component installation-alignment module has been separated from the interior wall of the panel and the magnetic lock and the panel has been moved subsequently to the closed position and wherein the latch lip is configured to mate with the catch support included in the discardable dual-component installation-alignment module to couple the catch to the catch support temporarily during the moving an assembly step.

3. The process of claim 2, wherein the catch support of the discardable dual-component installation-alignment module includes a catch-alignment tab that extends in perpendicular relation to the component-alignment plate and the latch lip is formed to include a tab receiver sized to receive a free end of the catch-alignment tab when the catch is coupled temporarily to the catch support.

4. The process of claim 3, wherein the tab receiver comprises a narrow-prong receiver and a wide-prong receiver that each open toward the component-alignment plate when the catch is coupled to temporarily to the catch support and wherein the catch-alignment tab comprises a narrow prong associated with the narrow-prong receiver and a relatively wider wide prong associated with the wide-prong receiver and arranged to lie in side-by-side laterally spaced-apart relation to the narrow prong.

5. The process of claim 3, wherein the catch support further comprises a tab rigidified coupled to a proximate end of the catch-alignment tab and to the component-alignment plate of the alignment template and the lock-guide tongue of the alignment template to rigidify the catch-alignment tab.

6. The process of claim 1, wherein the alignment template is L-shaped and the component-alignment plate has an inner surface that mates with the frame during the moving an assembly step to locate the catch plate in alignment with and in closely confronting relation to the catch-mounting zone on the frame and an opposite outer surface that mates with the interior wall of the panel during the moving the panel step to orient the lock-guide tongue of the alignment template to lie in perpendicular relation to the interior wall of the panel.

7. The process of claim 6, wherein the magnetic lock includes a tongue receiver comprising a first tongue-guide rib and a laterally spaced-apart second tongue-guide rib that cooperates with the first tongue-guide rib to receive the lock-guide tongue of the alignment template of the discardable dual-component installation-alignment module therebetween during the subsequently engaging a magnetic lock step so that the magnetic lock is located in alignment with and closely confronting relation to the lock-mounting zone on the interior wall of the panel and so that the lock-guide tongue of the alignment template of the discardable dual-component installation-alignment module is separate from the tongue receiver during the subsequently separating the component-alignment plate step.

8. The process of claim 7, wherein the magnetic lock includes a lock unit comprising a housing, a retractable latch arranged to move relative to the housing between a retracted position lying inside the housing to an extended position extending outside the housing, and a latch actuator comprising an internal magnet, the latch actuator is configured to move the retractable latch relative to the housing between the retracted position and the extended position, and the retractable latch is arranged to extend outwardly between the first and second tongue-guide ribs of the tongue receiver when the retractable latch is moved to assume the extended position so as to engage the catch that is mounted on the catch-mounting zone of the frame when the panel occupies the closed position.

9. The process of claim 1, wherein the magnetic lock is retained temporarily to the panel by the lock-guide tongue during the step of contacting.

10. A cabinet security system comprising a catch including a catch unit having a latch lip and a catch-unit fastener that is coupled to the catch unit and adapted to retain the catch unit in a stationary position on a top strip of a cabinet frame that is included in a cabinet and that is formed to include a cabinet aperture opening into an interior region of the cabinet, a magnetic external key separated from the cabinet and adapted to mate with an exterior wall of a movable cabinet panel included in the cabinet and mounted for movement relative to the cabinet frame between an opened position opening the aperture formed in the cabinet frame and a closed position closing the aperture formed in the cabinet frame, a magnetic lock including a lock unit that includes an internal magnet that is responsive to the magnetic external key and a lock-unit fastener that is coupled to the lock unit and adapted to retain the lock unit in a stationary position on an opposite interior wall of the movable cabinet panel to allow a retractable latch included in the lock unit to move to an extended position to engage the latch lip of the catch unit when the movable cabinet panel is moved to the closed position to retain the movable cabinet panel in the closed position closing the cabinet aperture formed in the cabinet frame, and a discardable dual-component installation-alignment module that is configured to mate with each of the catch unit and the lock unit and separable initially from the catch unit after the catch unit is initially retained in a stationary position on the top strip of a cabinet frame and that is later separable from the lock unit after the lock unit is subsequently retained in a stationary position on the opposite interior wall of the movable cabinet panel, wherein the discardable dual-component installation-alignment module comprises an alignment template associated with the movable cabinet panel and the lock unit and a catch support coupled to the alignment template and associated with the cabinet frame and the catch unit, wherein the alignment template includes a component-alignment plate that is adapted to be mounted in a template-mounting zone provided on the opposite interior wall of the movable cabinet panel and a lock-guide tongue that is coupled to the component-alignment plate to move therewith relative to the cabinet during installation of the catch unit on the top strip of the cabinet frame and the lock unit on opposite interior wall of the movable cabinet panel, wherein the catch support includes template-positioner means for temporarily engaging the catch unit during mounting of the catch unit in a stationary latch-engaging position on the top strip of the cabinet frame to cause the lock-guide tongue to be aligned with and arranged to lie under the catch unit after the catch unit is mounted in the stationary latch-engaging position to cause the component-alignment plate of the alignment template subsequently to be aligned with the template-mounting zone provided on the opposite interior wall of the movable cabinet panel when the movable cabinet panel is moved to the closed position, and wherein the lock unit includes an actuator housing that is adapted to be retained in a stationary mounted position on the opposite interior wall of the movable cabinet panel in a lock-mounting zone that is positioned on the opposite interior wall of the movable cabinet panel to lie adjacent to the template-mounting zone, and wherein the lock unit further includes tongue-receiver means on the actuator housing for receiving the lock-guide tongue of the alignment template therein after the component-alignment plate of the alignment template has been fixed in a stationary position in the template-mounting zone of the opposite interior wall of the movable cabinet panel and after the catch has been separated from the template-positioner means of the catch support of the alignment template during subsequent movement of the movable cabinet panel from the closed position to the opened position so that the lock unit is aligned with the latch lip of the catch each time the movable cabinet panel is moved from the opened position to the closed position.

11. The cabinet security system of claim 10, wherein the catch unit further includes a catch plate that is coupled to the latch lip and arranged to confront the top strip of the cabinet frame and the catch-unit fastener is coupled to the catch plate and arranged to mate with the top strip of the cabinet frame to retain the catch plate and the latch lip in a stationary position on the top strip of the cabinet frame.

12. The cabinet security system of claim 11, wherein the catch support is coupled to the component-alignment plate of the alignment template and arranged to lie above the lock-guide tongue of the alignment template and the catch support is formed to include the template-positioner means.

13. The cabinet security system of claim 12, wherein the latch lip is formed to include a prong receiver and the template-positioner means includes a prong that is coupled to the component-alignment plate and arranged to extend into the prong receiver formed in the latch lip of the catch.

14. The cabinet security system off claim 10, wherein the template-positioner means of the catch support comprises a catch-alignment tab that is coupled to and arranged to extend in perpendicular relation to the component-alignment plate and the latch lip of the catch is formed to include a tab receiver sized to receive a free end of the catch-alignment tab when the catch is coupled temporarily to the catch support.

15. The cabinet security system of claim 14, wherein the tab receiver comprises a narrow-prong receiver and a wide-prong receiver that each open toward the component-alignment plate when the catch is coupled temporarily to the catch support and wherein the catch-alignment tab comprises a narrow prong associated with the narrow-prong receiver and a relatively wider wide prong associated with the wide-prong receiver and arranged to lie in side-by-side laterally spaced-apart relation to the narrow prong.

16. The cabinet security system of claim 15, wherein the catch support further comprises a tab rigidifier coupled to a proximate end of the catch-alignment tab and to the lock-guide tongue of the alignment template to rigidify the catch-alignment tab.

17. The cabinet security system of claim 16, wherein the tab rigidifier is also coupled to the component-alignment plate of the alignment template.

18. The cabinet security system of claim 10, wherein the alignment template is L-shaped and the component-alignment plate has an inner surface that mates with the cabinet frame when the template-positioner means temporarily engages the catch unit and an opposite outer surface that mates with the opposite interior wall of the movable cabinet panel to facilitate retaining the actuator housing in the stationary mounted position on the opposite interior wall of the movable cabinet panel.

19. The cabinet security system of claim 18, wherein the tongue-receiver means comprises a first tongue-guide rib and a laterally spaced-apart second tongue-guide rib that cooperates with the first tongue-guide rib to receive the lock-guide tongue of the alignment template therein.

20. The cabinet security system of claim 19, wherein the retractable latch is arranged to extend outwardly between the first and second tongue-guide ribs when the retractable latch is moved to assume the extended position.

* * * * *